United States Patent [19]

Bartels

[11] Patent Number: 4,531,447

[45] Date of Patent: Jul. 30, 1985

[54] BARREL MOUNT FOR CANNON

[75] Inventor: Wolfgang Bartels, Kaarst, Fed. Rep. of Germany

[73] Assignee: Rheinmetall GmbH., Duesseldorf, Fed. Rep. of Germany

[21] Appl. No.: 443,070

[22] Filed: Nov. 19, 1982

[30] Foreign Application Priority Data

Nov. 21, 1981 [DE] Fed. Rep. of Germany ..... 3146165

[51] Int. Cl.[3] ..... F41F 21/06

[52] U.S. Cl. ..... 89/37.7

[58] Field of Search ..... 89/37 R, 37 E, 37 K; 308/176

[56] References Cited

U.S. PATENT DOCUMENTS

| | | | |
|---|---|---|---|
| 2,341,680 | 2/1944 | Williams | 89/193 |
| 3,854,377 | 12/1974 | Schiele | 89/36 K |
| 3,971,285 | 7/1976 | Ellis et al. | 89/14 C |
| 4,325,284 | 4/1982 | Grunewald et al. | 89/37 E |

FOREIGN PATENT DOCUMENTS

| | | |
|---|---|---|
| 2330890 | 1/1975 | Fed. Rep. of Germany . |
| 2330878 | 1/1975 | Fed. Rep. of Germany . |
| 282816 | 5/1952 | Switzerland . |
| 6870A | of 1915 | United Kingdom . |
| 558662 | 1/1944 | United Kingdom . |

*Primary Examiner*—Stephen C. Bentley

[57] ABSTRACT

A cannon has a barrel extending along a barrel axis and having in turn a cradle provided with a pair of trunnions centered on and defining a trunnion axis substantially perpendicular to the barrel axis. The gun carriage has a pair of cheeks spaced apart along the trunnion axis and juxtaposed with the trunnions. Respective gudgeons are secured to the cheeks centered on the trunnion axes and surrounding the trunnions. Respective axial bearings are braced axially between the trunnions and gudgeons and centered on the trunnion axis and respective radial bearings support the trunnions in the gudgeons for swiveling of the barrel about the trunnion axis in the carriage. Respective rings centered on the trunnion axis are threaded on the gudgeons. These rings are oppositely axially braced against the cheeks for axially loading the axial bearings. The rings can keep the axial bearings under axial compression so that there is no play at all in the joint.

1 Claim, 3 Drawing Figures

BARREL MOUNT FOR CANNON

FIELD OF THE INVENTION

The present invention relates to a cannon. More particularly this invention concerns the pivotal elevation mount for the barrel of a cannon on a gun carriage.

BACKGROUND OF THE INVENTION

A gun carriage can normally swivel about a vertical azimuth axis and has a pair of cheeks flanking the cradle of the barrel and supporting same so it can pivot about a horizontal elevation or range axis that is perpendicular to the azimuth axis. To shoot accurately it is essential that the barrel not move relative to the carriage except angularly about the horizontal elevation axis.

Accordingly it has been suggested in German patent document No. 2,330,890 to provide the gun cradle with trunnions, that is cylindrical pins projecting coaxially oppositely along the horizontal elevation axis from the gun cradle. The cheeks of the carriage carry sleeve-type gudgeon journals that receive these trunnions. The difficulty of putting together such an assembly is considerable as very close tolerances must be observed throughout. In addition the tendency of the gun, particularly with the cannon tipped, to twist when fired and to rub when swiveled subjects the various elements to considerable stress. Thus wear is common, so that the barrel of an old cannon will cant limitedly on the elevation axis and thereby shoot inaccurately.

Other large-caliber guns have complex systems for bracing the barrel cradle relative to the carriage. Normally they employ slip joints and complex tightening assemblies. With this type of system it is possible to adjust out any wear. Nonetheless this adjustment procedure is extremely complex and must be carried out at each trunnion. Furthermore the manufacture of such a cannon is a complex and expensive procedure, as everything must be made to very close tolerances.

OBJECTS OF THE INVENTION

It is therefore an object of the present invention to provide an improved barrel mount for a cannon.

Another object is the provision of such a barrel mount for a cannon which overcomes the above-given disadvantages.

A further object is to provide a relatively simple but tight support for a barrel on a gun carriage which allows wear to be adjusted out in the field by relatively simple means.

SUMMARY OF THE INVENTION

These objects are attained according to the instant invention in a cannon having, as is known, a barrel extending along a barrel axis and having a cradle provided with a pair of trunnions centered on and defining a trunnion axis substantially perpendicular to the barrel axis. The gun carriage has a pair of cheeks spaced apart along the trunnion axis and juxtaposed with the trunnions. Respective gudgeons are secured to the cheeks centered on the trunnion axes and surrounding the trunnions. According to this invention, respective axial bearings are braced axially between the trunnions and gudgeons and centered on the trunnion axis and respective radial bearings support the trunnions in the gudgeons for swiveling of the barrel about the trunnion axis in the carriage. Respective rings centered on the trunnion axis are threaded on the gudgeons. These rings are oppositely axially braced against the cheeks for axially loading the axial bearings.

Thus with this system roller bearings can carry the barrel on the carriage for extremely easy swiveling. The rings can keep the axial bearings under axial compression so that there is no play at all in the joint. These rings can easily be used for periodic adjustment to compensate for wear. To do so it is merely necessary to tighten one or both of the rings somewhat. This eliminates all complicated accounting for bearing tolerances and interposition of shims. It is also possible to back off the one ring and tighten the other to adjust the axial position of the barrel, since it is normal for the barrel centerline to lie parallel to and underneath or above the sight line.

According to this invention the cheeks have cheek faces perpendicular to the trunnion axis and the rings have ring faces perpendicular to the trunnion axis and confronting and engaging the respective cheek faces in surface contact. In this manner it is possible to use a large enough surface area for excellent force transmission to keep the axial bearing properly under compression, thereby inhibiting any minor canting that would engender excess wear. In addition the screwthread between the ring and gudgeon can be so fine that relatively little torque is needed to get the assembly quite tight, or to loosen it. Thus repairs and adjustments can be made in the field with hand tools.

In accordance with another feature of this invention the gudgeons have outer ends spaced sufficiently from the respective cheeks that the barrel axis can be positioned substantially offcenter in the carriage. Thus if necessary or desirable the barrel centerline can be offset horizontally from the carriage centerline, which normally is the sight line. Such mounting makes it possible to properly position the barrel even when the tolerances of the cheeks is relatively sloppy.

The instant invention further includes respective releasable latches engageable between the rings and the respective gudgeons for preventing rotation of the rings on the gudgeons. The rings are each formed with a plurality of outwardly open recesses angularly spaced relative to the trunnion axes. The latches are engageable with the recesses. In addition the carriage has recesses angularly spaced about the trunnion axis and engageable also by the latches. The spacing of the recesses of the carriage and of the rings are such that it is possible to secure the rings in virtually any possible angular position.

Each radial bearing according to this invention has an inner race carried on the respective trunnion. The respective axial bearing has a race braced axially against the respective inner race and pressing same axially against the cradle. Thus the bearings are roller bearings having inner races fixed on the respective trunnions and outer races fixed on the respective gudgeons. Such construction allows for extremely easy and smooth swiveling of the barrel on the carriage.

DESCRIPTION OF THE DRAWING

The above and other features and advantages will become more readily apparent from the following, reference being made to the accompanying drawing in which.

SPECIFIC DESCRIPTION

Figure 1:
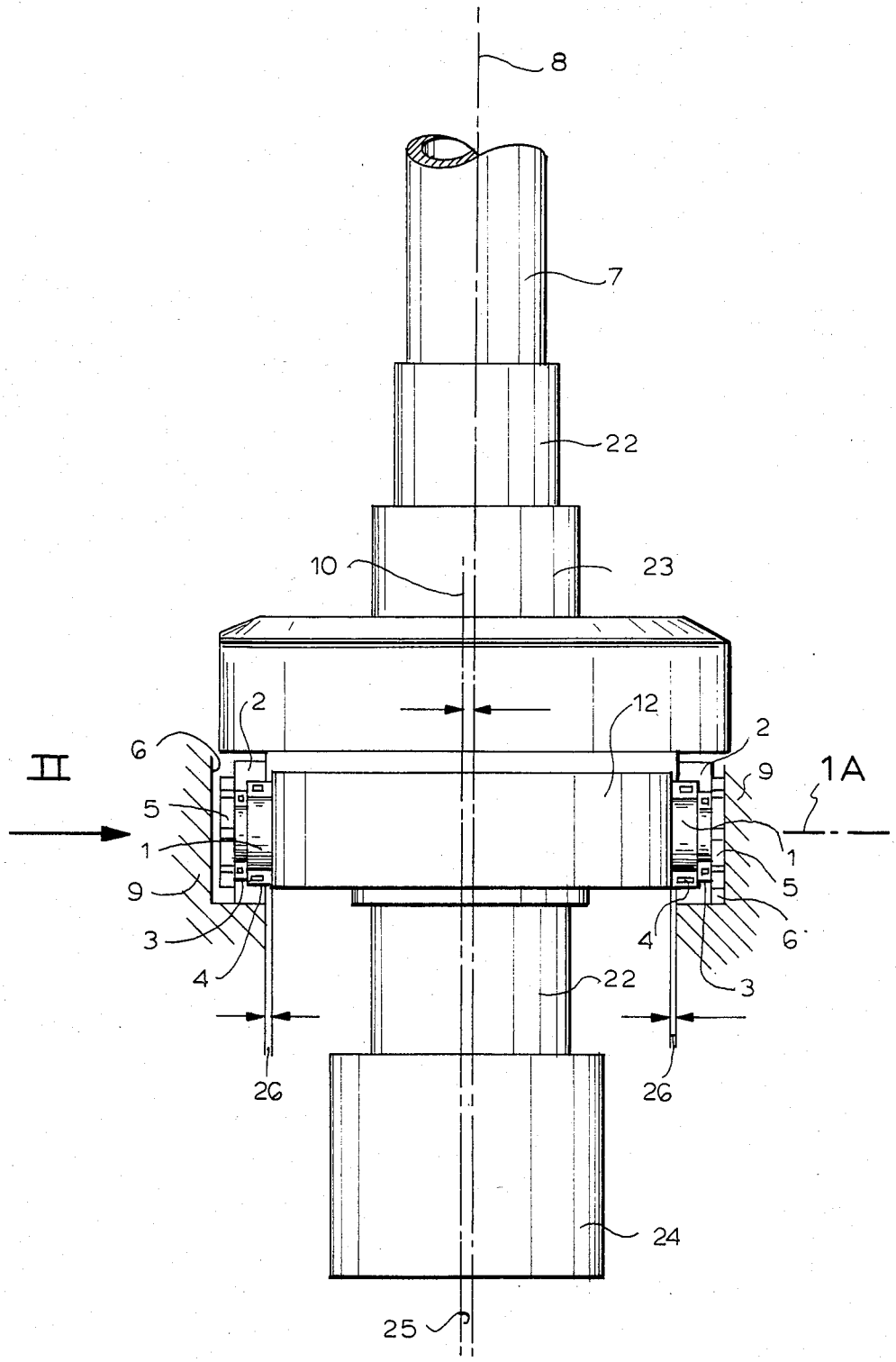
FIG. 1 is a top view of the cannon according to the present invention.

As seen in FIG. 1 a cannon according to this invention has a gun carriage normally swivelable about a central axis that would be perpendicular to the plane of the view and a pair of horizontally spaced cheeks 9. A gun barrel 7 having a centerline or axis 8 is held in a barrel tube 22 of a cradle 12 pivotal between the carriage cheeks 9 about a horizontal axis 1A. This barrel 7 is further provided with a mantlet or shields 23 and has at its rear end 24 the conventional recoil and loading mechanisms.

According to the invention the cradle 12 is formed with a pair of opposite cylindrical trunnions 1 centered on the axis 1A and received in axial-thrust and radial-thrust bearings 3 and 4 in gudgeons 2 carried in the cheeks 9 immediately inside of the faces 6 thereof, which faces 6 are planar and perpendicular to the axis 1A.

Figure 2:
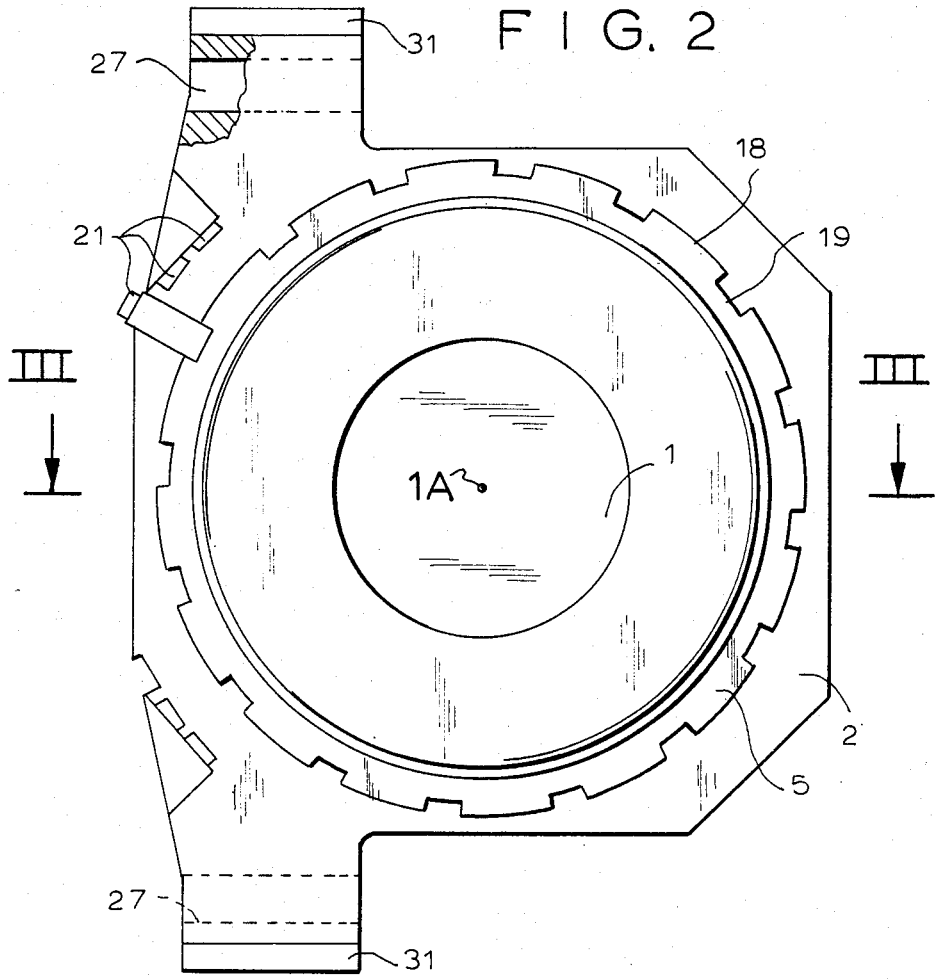
FIG. 2 is a large-scale end view taken in the direction of arrow II of a detail of the cannon.
Figure 3:
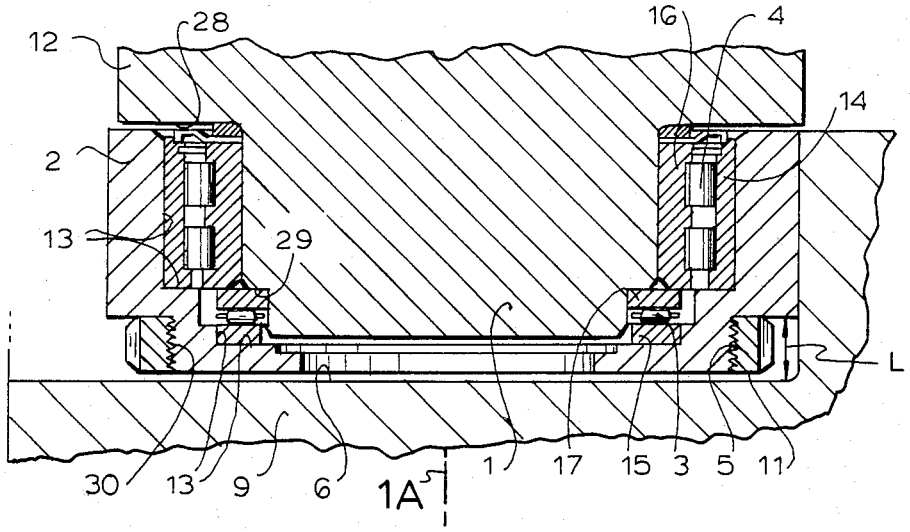
FIG. 3 is a section taken along line III—III of FIG. 2.

As best seen in FIGS. 2 and 3 each such gudgeon or mounting ring 2 is set axially in from the respective face 6 and is formed centered on the axis 1A with a screwthread 30 carrying a large-diameter ring 5 having a planar end face 11 that can be pressed flatly against the respective face 6.

The radial bearing 16 has an inner race 16 braced parallel to the axis 1A between a shoulder or face 28 of the cradle 12 surrounding the respective trunnion 1 and the back or inner race 17 of the axial bearing 3. This race 17 also rests on a shoulder 29 of the trunnion 1. The outer race 14 of each radial bearing 4 is fitted to the inside of the gudgeon 2 and secured axially therein. The outer race 15 of the axial-thrust bearing is fitted into a complementarily shaped cutout 13 of the gudgeon 2. Thus the entire gudgeon assembly formed by the gudgeon member 2 and the bearings 3 and 4 can be fitted accurately to the respective trunnion 1 at the factory.

For assembly of the piece, the barrel 7 complete with the gudgeon assemblies 2–5 is fitted between the faces 6 of the cheeks 9. Each gudgeon 2 has a pair of ears 31 formed with respective throughgoing slots 27 that open parallel to the centerline 10 of the carriage but that are elongated parallel to the axis 1A. Bolts are engaged through these slots 27 into threaded bores of the cheeks 9 but to start with are not tightened.

The centerline 8 of the barrel 7 is then adjusted normally to lie on the line 10 which is equidistant between the faces 6. With the two rings 5 screwed all the way toward each other on the respective gudgeons, this means that it is possible to move the entire barrel a distance 25 offcenter, here to the right as seen in FIG. 1 so the right-hand ring 5 engages the respective face 6 and the other ring 5 is clear of its respective face.

For initial setup the right-hand ring 5 is rotated, pushing axially outward against the corresponding face 6, until the centerlines 10 and 8 coincide or are in vertical alignment, or until the spacings 26 between the cradle 12 and each cheek 9 are equal, although unequal spacings 26 are permissible in many setups. Then the other ring 5 is screwed out until it bears against its face 6. Further screwing out of either ring 5 serves to load both of the axial bearings 4. Thereupon the bolts projecting parallel to the lines 8 and 10 are tightened down to fix the gudgeons 2 in place on the respective cheeks 9.

Each ring 5 has an outer periphery 18 formed with a plurality of angularly equispaced rectangular notches or cutouts 19. A latch 20 can engage in any of these notches 19 as well as in any of a plurality of angularly offset bores 21 in the respective gudgeon 2 to angularly arrest the rings 5 therein. In addition these notches allow rotation of the rings 5 manually by a wrench having an arcuate portion adapted to lie on the outer periphery 18 and having at one end a tooth adapted to fit in one of the cutouts 19 and at the opposite end a handle.

Subsequent tightening to compensate for wear of the bearings can be carried out in the field simply by releasing the latch 20, then screwing out the ring 5. Since the rings 5 are of relatively large diameter, there is considerable surface contact between the faces 11 and 6. Hence the force per unit of surface area is limited. In addition a relatively fine screwthread is used at 30 so adjustments can be carried out by hand. Hence a weapon can be kept tight for most accurate shooting. The means for doing so are simpler than most prior-art arrangements. Since considerable adjustment is possible, the cheeks 9 can be constructed to relatively sloppy tolerances.

I claim:

1. A cannon comprising:

a barrel extending along a barrel axis and having a cradle provided with a pair of trunnions centered on and defining a trunnion axis which is substantially perpendicular to the barrel axis;

a carriage having a pair of cheeks spaced apart along the trunnion axis and juxtaposed with the trunnions;

respective gudgeons secured to the cheeks centered on the trunnion axes and surrounding the trunnions;

respective axial bearings braced axially between the trunnions and gudgeons and centered on the trunnion axis;

respective radial bearings supporting the trunnions in the gudgeons for swiveling of the barrel about the trunnion axis in the carriage;

respective rings centered on the trunnion axis and threaded on the gudgeons, the rings being oppositely axially braced against the cheeks for axially loading the axial bearings;

said cheeks have cheek faces perpendicular to the trunnion axis and the rings have ring faces perpendicular to the trunnion axis and confronting and engaging the respective cheek faces in surface contact;

said gudgeons have outer ends spaced sufficiently from the respective cheeks so that the barrel axis can be positioned substantially offcenter in the carriage;

further comprising means including respective radially releasable latches engageable between the rings and the respective gudgeons for preventing rotation of the rings on the gudgeons;

said rings are each formed with a plurality of outwardly open cutouts equi-angularly spaced relative to the trunnion axis, the latches being selectively radially engageable with the cutouts and with said respective gudgeons; and wherein the gudgeon has recesses angularly spaced about the trunnion axis and engageable also by the latches.

* * * * *